US006997113B1

(12) United States Patent
Harding et al.

(10) Patent No.: US 6,997,113 B1
(45) Date of Patent: Feb. 14, 2006

(54) PALLET

(75) Inventors: Dennis P. Harding, Senecaville, OH (US); Darrell J. Haywood, Mount Holly, NC (US); David P. Jones, Warren, OH (US); John W. Knight, IV, New Concord, OH (US)

(73) Assignee: The Fabri-Form Company, New Concord, OH (US)

( * ) Notice: Subject to any disclaimer, the term of this patent is extended or adjusted under 35 U.S.C. 154(b) by 161 days.

(21) Appl. No.: 10/684,041

(22) Filed: Oct. 14, 2003

(51) Int. Cl.
*B65D 19/38* (2006.01)

(52) U.S. Cl. ..... 108/53.1; 108/53.3; 108/57.28

(58) Field of Classification Search ..... 108/53.1, 108/53.3, 53.5, 51.11, 57.28, 57.25
See application file for complete search history.

(56) References Cited

U.S. PATENT DOCUMENTS 3,481,285 A * 12/1969 Yellin ..... 108/57.28
3,603,272 A * 9/1971 Ditges ..... 108/57.28
3,640,229 A * 2/1972 Bell ..... 108/57.28
4,369,716 A * 1/1983 Munk et al. ..... 108/57.28
4,809,618 A * 3/1989 Bell ..... 108/57.28
5,566,624 A * 10/1996 Brown et al. ..... 108/57.28
5,964,162 A * 10/1999 Chuan-Jen ..... 108/57.28
6,386,118 B1 * 5/2002 Bendit et al. ..... 108/57.25
6,807,911 B1 * 10/2004 Carson et al. ..... 108/57.28

* cited by examiner

*Primary Examiner*—Jose V. Chen
(74) *Attorney, Agent, or Firm*—Renner, Kenner, Greive, Bobak, Taylor & Weber

(57) ABSTRACT

A pallet (10) includes a deck (14) and a plurality of legs (12) extending downwardly from the deck (14). The deck (14) includes recessed and raised areas (16, 18), wherein the raised areas (18) lie in a substantially horizontal top plane (T), and the recessed areas (16) lie in a substantially horizontal bottom plane (B). The raised and recessed areas (18, 16) are interconnected to each other by an upstanding wall (22).

20 Claims, 5 Drawing Sheets

PALLET

TECHNICAL FIELD

The present invention generally relates to a pallet. In particular, the present invention relates to a plastic pallet having an alternating pattern of raised and recessed areas forming the deck of the pallet.

BACKGROUND OF THE INVENTION

Pallets are used in a variety of industries and generally act as platforms that facilitate the transport of bulky or heavy materials. The most common pallet is a wooden pallet having a deck constructed of a plurality of slats. While wooden pallets enjoy widespread use, they have some disadvantages including their susceptibility to insect infestation, warping, and rotting. Consequently, wooden pallets must be repeatedly treated resulting in substantial maintenance costs.

As a solution to these problems, plastic pallets have been developed. As will be appreciated, plastic pallets may be more expensive than their wooden counterparts. But, in general, they weather better than wooden pallets and are not susceptible to insect infestation allowing continued use of the pallet without further treatment.

While plastic pallets have generally improved upon their wooden counterparts, current pallet designs still have some drawbacks. In particular, to obtain the necessary strength for supporting large loads, these pallets may require a great amount of plastic material and are quite heavy. In particular, compression molded plastic pallets may have a weight of at least 30 pounds, and injection molded pallets may have a weight of about 16 to 17 pounds The present designs include a number of downwardly extending legs that extend from a deck made of a plurality of thin slats that are arranged in a screen or lattice-like fashion with a plurality of holes formed therebetween. These slats generally are thin members that span the entire width of the pallet between the legs. These members are particularly susceptible to bending and buckling when subjected to heavy loads. Consequently, it is desirable to design a pallet with an improved deck that is less susceptible to buckling.

Moreover, because of their cost, existing pallets often must be returned after a shipment is completed. Consequently, additional expense is incurred to ship the empty pallets back to the user. A lighter weight pallet would be beneficial in terms of the cost of shipping the pallets back after use or may be effective in one-way shipments, where the pallet is not returned.

SUMMARY OF THE INVENTION

It is an object of the present invention to provide an improved pallet which is less costly and which includes a deck that is less susceptible to buckling.

This and other objects of the present invention, as well as the advantages thereof over existing prior art forms, which will become apparent from the description to follow, are accomplished by the improvements hereinafter described and claimed.

In general, a pallet made in accordance with the present invention includes a plurality of legs extending downwardly from a deck that includes raised and recessed areas. The raised areas lie in a substantially horizontal top plane and the recessed areas lie in a substantially horizontal bottom plane. The raised and recessed areas are interconnected to each other by an upstanding wall.

The present invention further provides a pallet including a deck having a plurality of raised and recessed areas that respectively lie in a substantially horizontal top plane and a substantially horizontal bottom plane. The top and bottom planes are vertically spaced from each other. The raised and recessed areas include planar webs having a polygonal shape that respectively lie in the top and bottom planes and are interconnected to each other by an upstanding wall. The raised and recessed areas are arranged on the deck in an alternating pattern. The pallet further includes a plurality of legs extending downward from the deck below the bottom plane to define a gap beneath the bottom plane and between the legs.

A preferred exemplary pallet according to the concepts of the present invention is shown by way of example in the accompanying drawings without attempting to show all the various forms and modifications in which the invention might be embodied, the invention being measured by the appended claims and not by the details of the specification.

DETAILED DESCRIPTION OF THE INVENTION

Figure 1:
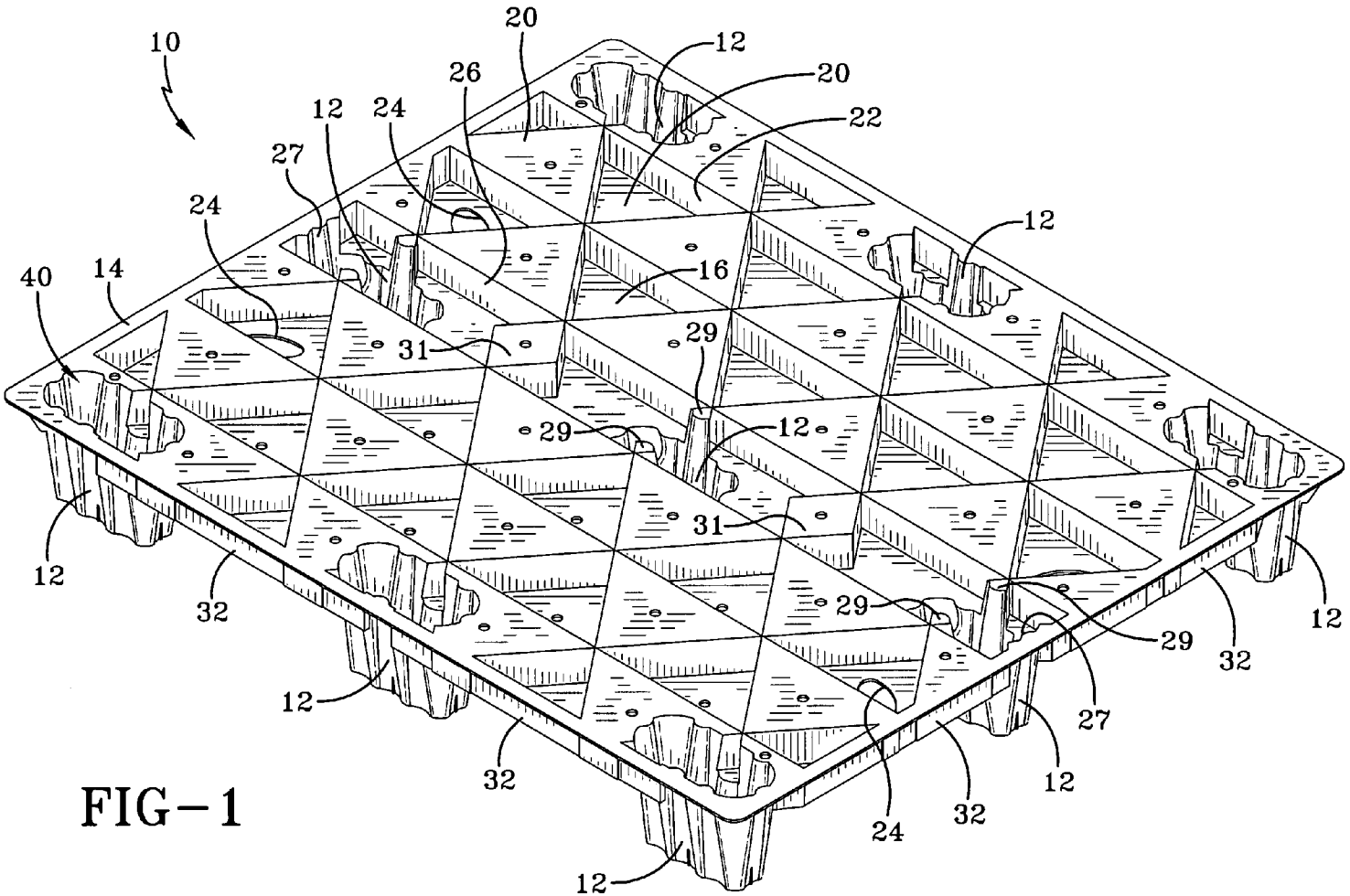
FIG. 1 is a perspective view of a pallet according to the concepts of the present invention.
Figure 2:
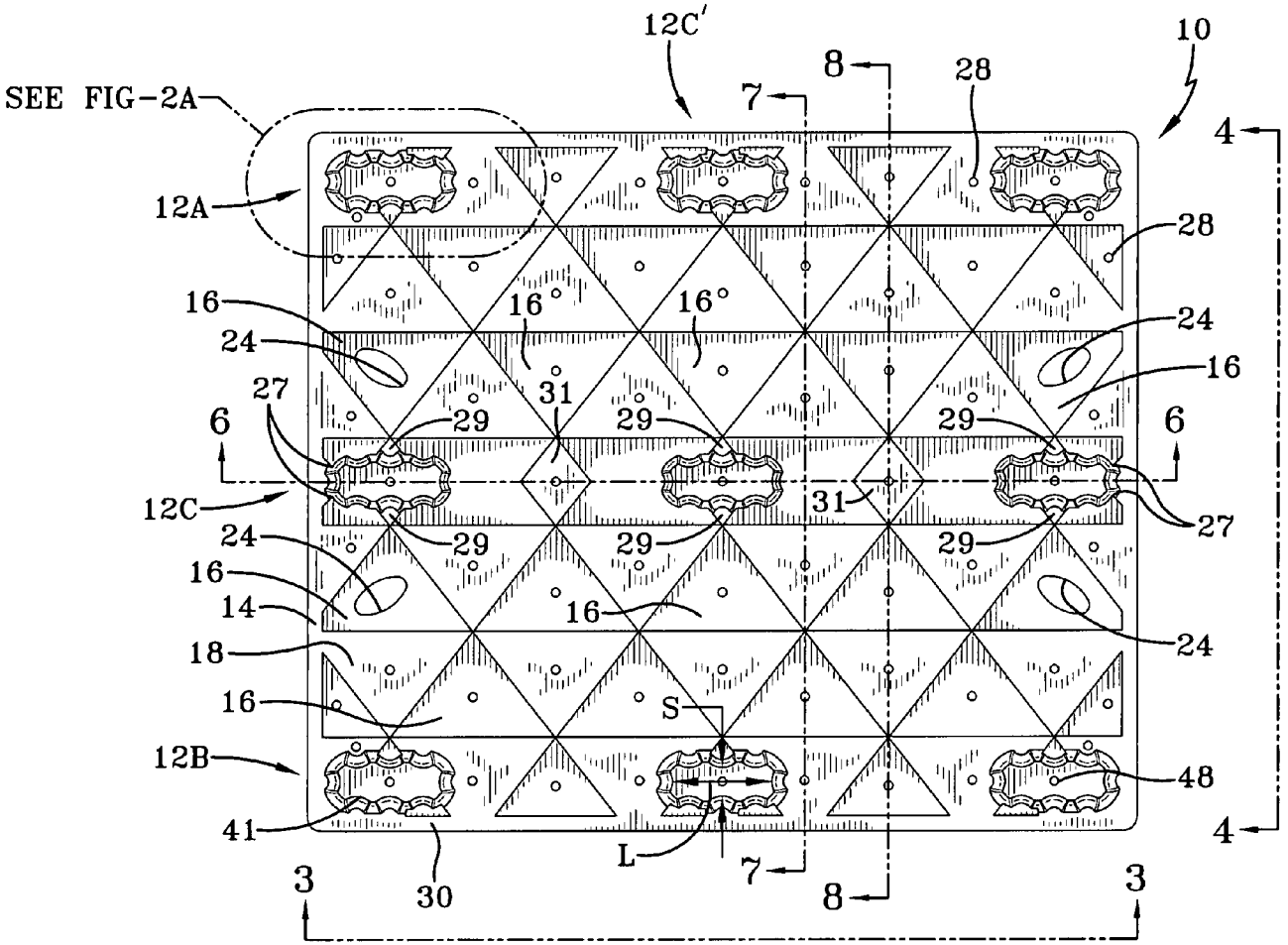
FIG. 2 is a top plan view of the pallet depicted in FIG. 1.
Figure 4:
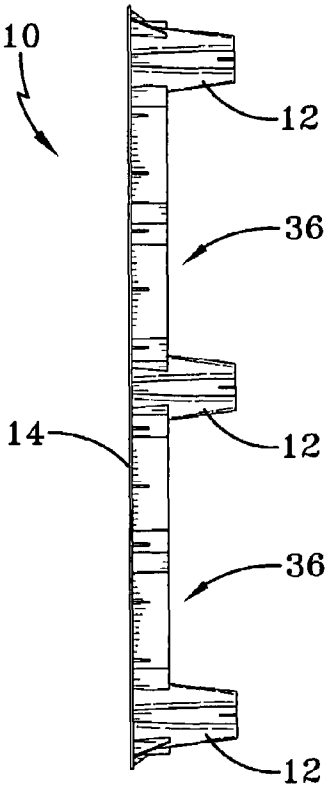
FIG. 4 is a right side elevational view of the pallet depicted in FIG. 1.
Figure 2A:
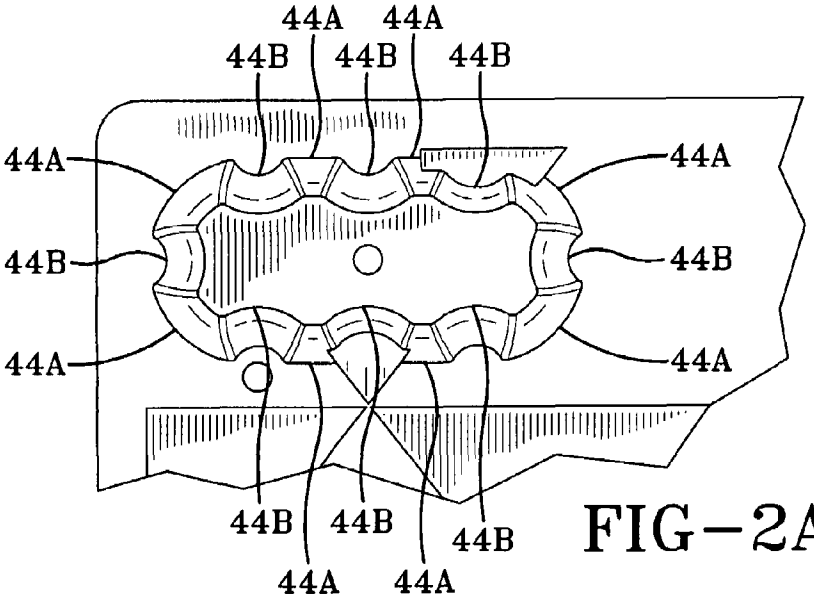
FIG. 2A is an enlarged top plan view of the area outlined in FIG. 2.
Figure 8:
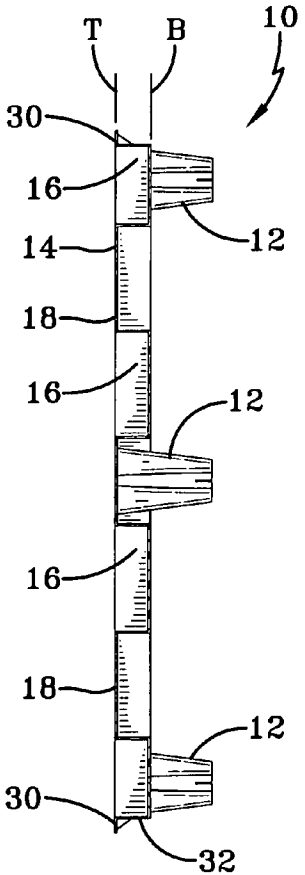
FIG. 8 is a sectional side elevational view of the pallet taken substantially along line 8—8 in FIG. 2.
Figure 7:
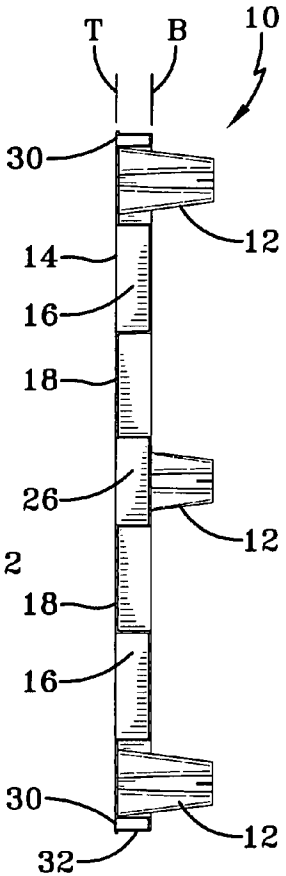
FIG. 7 is a sectional side elevational view of the pallet taken substantially along line 7—7 in FIG. 2.

A pallet according to the concepts of the present invention is generally indicated by the numeral 10 in the accompanying drawings. Pallet 10 generally includes a plurality of legs 12 and a deck 14. As best shown in FIG. 1, deck 14 includes a plurality of recessed areas 16 and a plurality of raised areas 18. The recessed and raised areas 16, 18 each may include a web 20 that is a planar member that may extend generally horizontally. As best shown in FIGS. 7 and 8, webs 20 of recessed and raised portions 16, 18 respectively lie in a pair of vertically spaced planes, namely, a bottom plane B and a top plane T. The surface defined by the webs 20 of raised areas 18 forms the supporting surface for most items placed on the deck 14. The webs 20 of recessed areas 16 and raised areas 18 are connected to each other by an upstanding wall 22, which may extend generally perpendicular to the webs 20. The upstanding walls 22 have the effect of creating a honeycomb that is further strengthened by the triangular webs 20 of material that interconnect these walls 22. In the example shown, the recessed and raised areas 16, 18 have been given a geometric shape, and in particular, a triangular shape. It will be appreciated that any number of shapes may be used including other polygonal shapes or irregular shapes. As best shown in FIG. 2, the shape of the webs 20 may be that of a regular polygon, namely, an equilateral triangle.

The recessed and raised areas 16, 18 may be arranged in a pattern, such as the alternating raised and recessed pattern shown. It will be appreciated that the pattern does not have to cover the entire surface of the deck 14 and may be truncated at the periphery of the deck 14 due to size limitations, as best seen, for example in FIG. 2. As shown, the pattern may include rows of alternating recessed and raised areas 16, 18 arranged such that an adjacent row is offset, in terms of the raised or recessed area, to create alternating columns of recessed and raised areas 16, 18 as well.

To prevent water from collecting on the deck 14, each web 20 may be provided with at least one drainage hole 28, as shown. To facilitate handling of the pallet 10, the deck 14 may be provided with one or more holds 24. It will be appreciated that a hold 24 may be any surface that facilitates the grasping of the pallet 10 by a user including, for example, the oval shaped holes shown formed in recessed areas 16. It will further be appreciated that the holds 24 may be placed at any location on the deck 14. In the example shown, holds 24 are located in the recessed areas 16 near the periphery of the deck 14 and on either side of a centrally formed trench 26, described more completely below.

Figure 6:
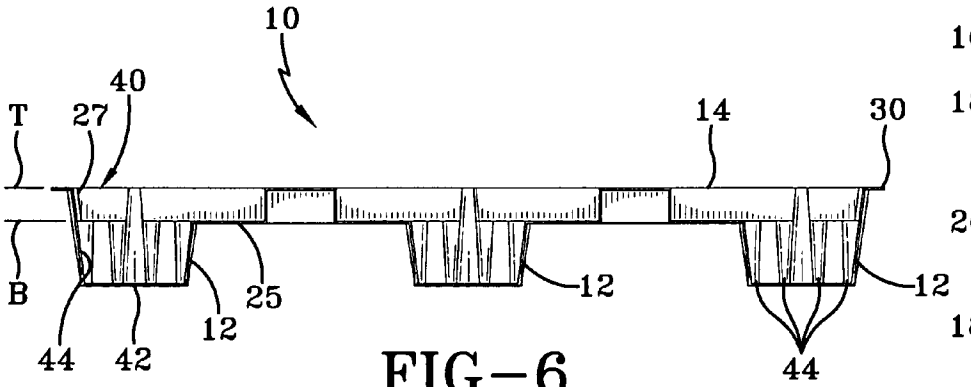
FIG. 6 is a sectional front elevational view of the pallet taken substantially along line 6—6 in FIG. 2.

As best shown in FIGS. 1, 2 and 6, a trench 29 may be formed in the center of the deck 14, and divide the deck 14 into halves. The trench 26 may be generally rectangular as shown and extend downwardly to the same extent as the recessed areas 16, or in other words, the base 25 of the trench 26 resides within the bottom plane B (FIG. 6).

To strengthen the deck 14 at the ends of the trench 26, a number of reinforcing folds 27 may be formed at either end of the trench 26 at the outer wall 32 of the deck 14. These folds 27 have the effect of increasing the moment of inertia of the wall 32 at the ends of the trench 26 to help it resist buckling. Similarly, reinforcing columns 29 may extend upwardly from the base 25 of the trench 26 along its length. In the example shown, columns 29 are provided adjacent to legs 12 formed within trench 26 and extend upwardly from the base 25 of the trench 26 adjacent to a recessed portion 16, as best shown in FIGS. 1 and 2. To provide support for any boxes or other material that might extend over the edge of the trench 26, block-like spacers 31 may be formed in the trench 26, as shown in FIG. 1. The spacers 31 may be located centrally between the legs 12, as shown, and may be useful in supporting the edges or corners of items that are not large enough to fill the entire pallet 10. For example, boxes having a size smaller than that of the pallet 10 are often stacked adjacent one another with their edges meeting over the trench 26 would contact spacers 31.

As depicted in the given example, the spacers 31 may be placed adjacent to recessed area 16 to further strengthen the deck 14 and provide continuity within the alternating pattern of recessed and raised areas 16, 18. In terms of manufacturing, trench 26 facilitates outward flow of material from the center in a compression molding process. It will be appreciated that the trench 26 is not a necessary part of the design and the alternating pattern of recessed and raised areas 16, 18 may continue in place of the trench. In such an example, the pattern of such areas 16, 18 would cover the entire deck 14.

Figure 3:
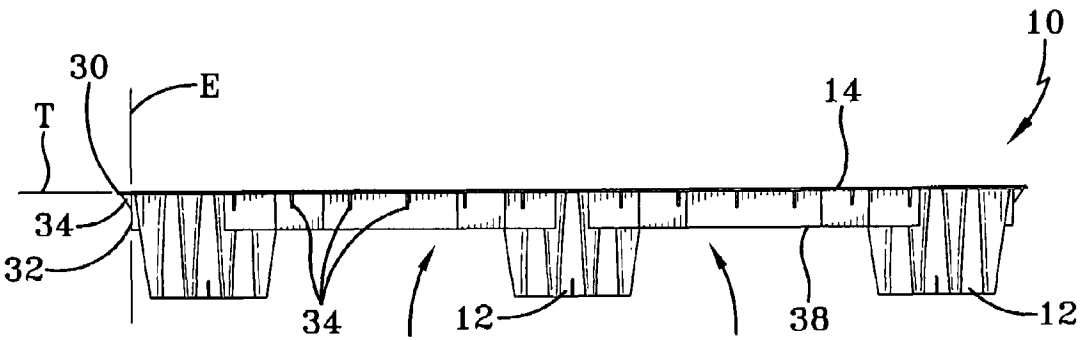
FIG. 3 is a front elevational view of the pallet depicted in FIG. 1.
Figure 5:
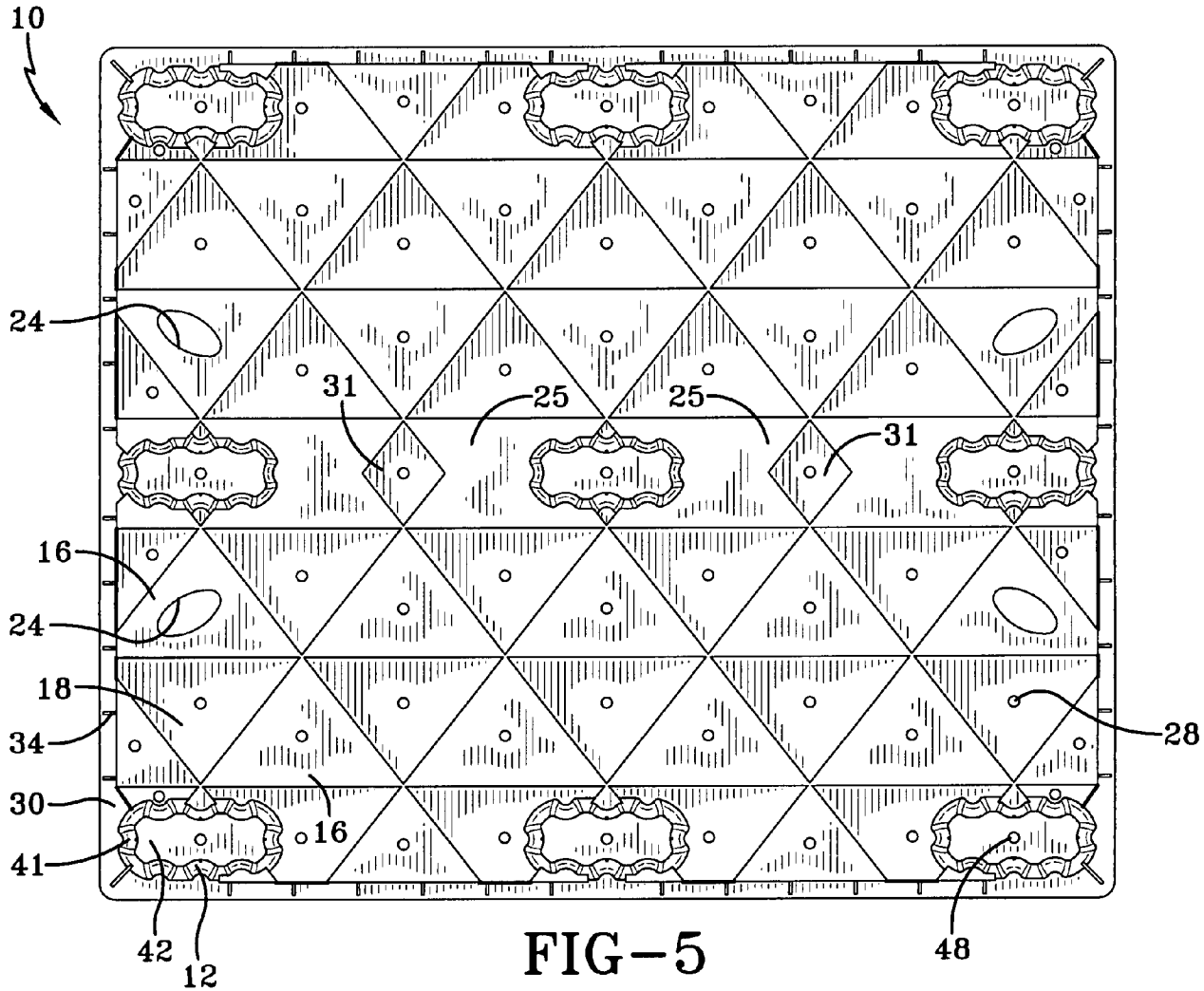
FIG. 5 is a bottom plan view of the pallet depicted in FIG. 1.

A rim 30 may be formed at the periphery 24 of the deck 14 and lie in the top plane T (FIG. 3). The rim 30 extends outward of the plane E formed by the outer wall 32 of the deck 14. In this way, the outwardly extending rim 30 provides a convenient place to grasp the pallet 10 when moving it by hand. The rim 30 may be reinforced by gussets 34 extending between the rim 30 and wall 32, as best shown in FIG. 3. It will be seen in FIG. 2, that the triangular webs 20 of the given example terminate at the rim 30 causing the triangular areas 16, 18 to be truncated.

As mentioned above, the deck 14 is supported on legs 12. The legs 12 may be of generally any form and preferably extend downwardly from the deck 14 an extent sufficient to create a gap 36 between the bottom surface 38 of the deck 14 and the supporting surface on which pallet 10 stands. This facilitates movement of pallet 10 by a forklift or similar device. With this in mind, legs 12 may be arranged to define a central space into which the forks of a forklift may be inserted. In the example shown, three rows (12A, 12B, 12C) of three legs 12 are provided with fork receiving gaps 36 formed on either side of the central row (12C) and central column (12C') formed by the legs 12. In the example shown, the deck 14 has a square shape at its periphery 24 and, thus, the legs 12 are evenly spaced from each other in both the lateral and longitudinal directions. It will be appreciated, however, that other deck shapes may be used causing the spacing and number of legs 12 to vary from the depicted example.

With reference to FIGS. 1, 2 and 6, legs 12 may be formed as cup-like members that extend downward from the deck 14. To that end, the legs 12 may include an open top, generally indicated at 40, a base 42 and an upstanding sidewall 44 that extends downwardly from the deck 14 to the base 42. To provide strength to the leg 12 particularly in the vertical direction, legs 12 may be formed with an irregular section that defines a plurality of partial columns or folds 44. As best shown in FIG. 2, these folds 44 may be defined all around the periphery of the leg 12 to increase the leg's moment of inertia and reduce its susceptibility to buckling. While any number of folds 44 may be formed, in the example shown, approximately sixteen folds 44 are used. The folds 44 may have any form including, for example, convex folds 44A that project outward relative to leg 12 and concave folds 44B that project inward relative to leg 12. As shown such folds 44A, 44B may be arcuate with smooth transitions between adjacent folds 44.

In the example shown, legs 12 are somewhat rectangular in shape having, as indicated in FIG. 2, a short side defined by axis S oriented longitudinally and a long side defined by axis L oriented laterally. A single concave fold 44B longitudinally spaces convex folds 44A located at each corner of the leg 12 and three concave folds 44B lie along the laterally extending sides of the leg 12 separating the convex folds 44A at the corners from a pair of convex folds 44A formed along the lateral side between the corners. These folds 44A are in turn separated from each other by the third concave fold 44B. The result is a very rigid structure that may be made extremely lightweight and yet carry large loads before buckling.

As best shown in FIG. 6, the wall 44 may further taper inward from the open top 40 toward the base 42. In this way, the legs 12 permit nesting of multiple pallets 10 by providing recesses at 40 adapted to receive the legs 12 of another pallet 10.

The pallet 10 may be formed of any polymeric material including high density polyethylene. The pallet 10 may be constructed as a unitary structure, as shown, or assembled from separate components, for example, legs 12 may be attached to a separately formed deck 14. The pallet 10 may thus be formed with any molding or similar process used to manufacture polymeric products. In the example shown, pallet 10 is constructed in a compression molding process. As will be understood by one of ordinary skill, the compression molding process includes providing a pair of mold halves with a billet of material placed within the mold before the halves are squeezed together to cause the billet to flow throughout the mold. As will be appreciated, with fewer corners and sides to work with, the material is better able to flow and form the desired shape. Therefore, while any shaped web 20 may be used, the triangular web shapes shown in the drawings were chosen because it has the fewest sides and corners of a regular geometric shape. Thus, the use of the triangular web 20 is believed to facilitate the flow of material within the mold. This shape, however, is not limiting.

The resulting pallet 10 with raised and recessed webs 20 interconnected by a network of upstanding walls 22 results in a lightweight pallet 10 having a load capacity commensurate with that of existing pallets. For example, the depicted pallet 10 has been found capable of supporting loads in excess of 2,000 pounds The increased strength provided by the alternating raised and recessed deck design allows the pallet 10 to be constructed with less material resulting in a lighter pallet. For example, a pallet 10 similar to that depicted has a weight of about 14.5 pounds This is less than half of the weight of a comparable compression molded plastic pallet existing in the art and is even lighter than injected molded pallets. As will be appreciated, any weight savings becomes extremely significant when considering the large number of pallets used in transporting cargo on trailers, airplanes, and boats. Further, the lightweight pallet 10 is easier to handle. The savings in material and use of a compression molded product allows the pallet 10 to be constructed at extremely low cost. This in connection with the weight savings makes the pallet 10 attractive for one way use applications. By one way use applications, it will be understood that the pallet 10 is shipped to a destination and then not returned. The cost of existing pallets has made this practice undesirable and typically pallets must be returned. As will be appreciated, some efficiency in shipping is lost by shipping back the empty pallets.

In light of the foregoing, it should thus be evident that a pallet constructed as described herein substantially improves the art and otherwise accomplishes the objects of the present invention.

What is claimed is:

1. A pallet comprising a deck, a plurality of legs extending downwardly from said deck, said deck having raised and recessed areas arranged in an alternating pattern relative to each other, said raised areas lying in a substantially horizontal top plane, said recessed areas being vertically spaced from said raised areas and lying in a substantially horizontal bottom plane, an upstanding wall interconnecting said raised and recessed areas; and a trench formed centrally within and substantially spanning said deck, said trench having a base that lies in said bottom plane, said raised and recessed areas being formed on both sides of said trench.

2. The pallet of claim 1 further comprising a support column extending upwardly from the base of said trench and being located adjacent a to said recessed area located adjacent to said trench.

3. The pallet of claim 1 further comprising a spacer extending upward from said base of said trench and having a top surface lying in said top plane.

4. The pallet of claim 3, wherein said spacer extends across said trench and is located adjacent recessed areas on both sides of said trench and interconnected therewith at said upstanding wall.

5. The pallet of claim 1 further comprising a reinforcing fold at each end of said trench formed in an outer wall of said deck.

6. The pallet of claim 1, wherein each of said raised and recessed areas include a drainage hole positioned therein.

7. The pallet of claim 1, wherein said raised and recessed areas have a polygonal form.

8. The pallet of claim 1, including three rows of three legs that are aligned with each other and formed integrally with said deck, said legs extending downward below said bottom plane and defining a pair of gaps on either side of a center row of said legs and on either side of a center column of said legs.

9. The pallet of claim 1, wherein said legs are hollow having a leg base and an upstanding sidewall extending from said leg base to said deck.

10. The pallet of claim 9, wherein said upstanding sidewall of each of said legs defines a plurality of folds adapted to resist buckling loads placed on said deck.

11. The pallet of claim 10, wherein said folds include at least one convex fold and at least one concave fold.

12. The pallet of claim 9, wherein said legs have a generally rectangular profile and wherein said upstanding sidewall of each said leg includes a plurality of reinforcing folds, wherein said folds include convex folds formed at each corner of each said leg and spaced from each other by at least one concave fold and wherein an additional convex fold is formed along each long side of said leg between said convex folds formed at said corners, wherein said additional convex fold is spaced from said folds at said corners by at least one concave fold.

13. The pallet of claim 9, wherein said base of said legs includes a drainage hole.

14. The pallet of claim 1, wherein said legs have an open top at said deck, and wherein said sidewall of each said leg tapers from said top inward toward said base defining a tapered recess.

15. The pallet of claim 1 further comprising a hold, wherein said hold is an opening formed in said deck.

16. The pallet of claim 1, wherein said deck has an outer wall formed about its periphery and a rim extending outwardly from said deck beyond said outer wall.

17. The pallet of claim 1, wherein the pallet is formed as a unitary structure from a single billet of polymeric material.

18. A pallet comprising a deck having a plurality of raised and recessed areas, said raised areas lying in a substantially horizontal top plane and said recessed areas lying in a substantially horizontal bottom plane, said top and bottom planes being vertically spaced from each other, wherein said raised and recessed areas include substantially planer webs interconnected to each other by an upstanding wall, said raised and recessed areas being arranged on said deck in an alternating pattern, a centrally-formed trench formed centrally within said deck and substantially spanning said deck, where said trench is formed independently of said raised and recessed areas and has a base lying in said bottom plane and an upstanding wall that extends upward from said base to said top plane about the periphery of said trench, wherein both raised and recessed areas lie adjacent to said trench; and a plurality of legs extending downward from said deck below said bottom plane.

19. A pallet comprising a deck having a plurality of raised and recessed areas, said raised areas lying in a substantially horizontal top plane and said recessed areas lying in a substantially horizontal bottom plane, said top and bottom planes being vertically spaced from each other, wherein said raised and recessed areas include webs lying respectively in said top and bottom planes and interconnected to each other by an upstanding wall, said raised and recessed areas being arranged on said deck in rows and columns and in an alternating pattern, wherein said raised and recessed areas alternate with respect to each other along both said rows and said columns.

20. A pallet comprising a deck having a plurality of raised and recessed areas, said raised areas lying in a substantially horizontal top plane and said recessed areas lying in a substantially horizontal plane, said top and bottom planes being vertically spaced from each other, wherein said raised and recessed areas include planer webs lying respectively in said top and bottom planes and interconnected to each other by an upstanding wall, said raised and recessed areas being arranged on said deck in an alternating pattern, wherein said raised and recessed areas alternate with respect to each other; wherein said webs have a substantially triangular shape.

* * * * *